US006374823B1

(12) United States Patent
Hajianpour

(10) Patent No.: US 6,374,823 B1
(45) Date of Patent: Apr. 23, 2002

(54) DISPOSABLE VENTILATED FACE SHIELD AND HEAD COVERING

(76) Inventor: Mohammed Ali Hajianpour, 1706 Vestal Dr., Coral Springs, FL (US) 33071

( * ) Notice: Subject to any disclaimer, the term of this patent is extended or adjusted under 35 U.S.C. 154(b) by 0 days.

(21) Appl. No.: 09/524,793

(22) Filed: Mar. 14, 2000

(51) Int. Cl.[7] ..... A62B 17/04; A62B 18/00

(52) U.S. Cl. ..... 128/201.22; 128/201.23; 128/201.29; 128/205.29; 128/206.12; 128/206.28

(58) Field of Search ..... 128/201.22, 201.23, 128/201.24, 201.25, 202.19, 201.29, 206.21, 207.11, 205.25, 200.27, 200.28, 206.23, 206.25; 2/202, 205, 9, 417, 421, 424

(56) References Cited

U.S. PATENT DOCUMENTS

| | | | | | |
|---|---|---|---|---|---|
| 3,181,532 | A | * | 5/1965 | Harris | 128/142 |
| 3,963,021 | A | * | 6/1976 | Bancroft | 128/145 |
| 4,055,173 | A | * | 10/1977 | Knab | 128/139 |
| 4,462,399 | A | * | 7/1984 | Braun | 128/201.25 |
| 4,466,432 | A | * | 8/1984 | Wise | 128/201.23 |
| 4,683,880 | A | * | 8/1987 | Werjefelt | 128/201.28 |
| 4,752,974 | A | | 6/1988 | Haino | 2/424 |
| 4,893,356 | A | * | 1/1990 | Waters | 2/171.3 |
| 4,986,282 | A | | 1/1991 | Stackhouse et al. | 128/857 |
| 5,035,239 | A | * | 7/1991 | Edwards | 128/205.23 |
| 5,113,853 | A | * | 5/1992 | Dickey | 128/200.28 |
| 5,125,402 | A | * | 6/1992 | Greenough | 128/201.25 |
| 5,283,914 | A | * | 2/1994 | James | 2/424 |
| 5,533,500 | A | * | 7/1996 | Her-Mou | 128/201.25 |
| 5,588,153 | A | | 12/1996 | Ignon et al. | 2/457 |
| 5,592,936 | A | | 1/1997 | Thomas, Jr. et al. | 128/206.12 |
| 5,819,728 | A | * | 10/1998 | Ritchie | 128/201.23 |
| 5,937,445 | A | | 8/1999 | Ravo et al. | 2/173 |
| 5,966,746 | A | | 10/1999 | Reedy et al. | 2/436 |
| 6,014,971 | A | * | 1/2000 | Danisch et al. | 128/201.25 |

OTHER PUBLICATIONS

Health Devices, Apr., 1996, vol. 25, No. 4, pp. 116–145.

Mark G. Siegal, Alan S. Echt, G. Edward Burroughs, and Steven W. Lenhart, "Levels of Carbon Dioxide in Helmet Systems Used during Orthopaedic Operations," The Journal of Bone and and Joint Surgery, Incorporated, vol. 80A, Sep. 1998, pp. 1264–1269.

* cited by examiner

*Primary Examiner*—John G. Weiss
*Assistant Examiner*—Darwin Erezo
(74) *Attorney, Agent, or Firm*—Ronald V. Davidge

(57) ABSTRACT

A protective structure for use in a surgical environment includes a face shield formed as a transparent tube to extend around the wearer's head and a cloth head covering extending above and around the face shield, with a viewing aperture being formed in the head covering to extend in front of the wearer's face, and with the head covering being attached to the face shield around the viewing aperture. A support structure extends from a rear portion of the face shield to a front portion thereof, forming an air channel through which air is moved by an internal fan between an air inlet aperture in the head covering at the rear of the support structure and an air outlet at the front of the support structure above the wearer's face.

11 Claims, 2 Drawing Sheets

DISPOSABLE VENTILATED FACE SHIELD AND HEAD COVERING

BACKGROUND INFORMATION

1. Field of Invention

This invention relates to protective apparatus for use by surgeons, dentists, and associated personnel during operations, and, more particularly, to such apparatus used for maintaining sterile operating conditions outside the apparatus while protecting the individual wearing the apparatus from coming into contact with splattered blood and tissue during orthopedic procedures.

2. Description of the Related Art

Fully covering protective garments, including a face shield and cloth covering the head and shoulders, are becoming increasingly common in operating rooms, particularly to protect the individual wearing the garment while providing sterile conditions for the operation outside the garment.

As reported in Health Devices, April, 1996, Vol. 25, No. 4, pp. 116–145, a surgical helmet system, in the form of either a loose-fitting hood or a hood combined with an integral gown, called a toga system, has been used particularly during orthopedic procedures to decrease the risk to the patient of deep wound infection by keeping skin and other particles from the surgeon's face from falling into an open surgical site. Such a system has also been used to protect the surgical staff from infections blood splashes and from potentially infections aerosols generated by power tools during orthopedic procedures. This aspect of the use of such equipment provides particular protection against infection by the human immunodeficiency virus (HIV), by tuverculosis, and by the hepatitis C (HCV) virus.

Within a typical surgical helmet system, the helmet is an open framework molded from a thermoplastic resin, together with a structure forming an airpath extending from a location adjacent the rear of the wearer's head to a location adjacent the wearer's forehead. This structure includes an electric motor driven by a rechargeable battery fastened to a strap extending. An example of this type of helmet is described in U.S. Pat. No. 5,592,936 to Thomas, Jr., et al, which particularly discloses an air filtration system filtering air both entering and exiting the helmet area.

A typical surgical helmet system, as worn during an operating procedure, also includes a hood having a clear face shield, with the remainder of the hood being fashioned from a fabric material having an aperture to which the clear face shield is adhesively attached. The helmet and the hood are separate subsystems, which are not placed together until they are placed on the individual who is to wear them. After the procedure is completed, the hood is disposed, while the helmet will by used many more times.

A first problem with this type of surgical helmet system arises from the fact that the helmet is reused. Since it is generally used by a number of individuals, and since it fits closely around the head and face, the helmet itself may pass an infection from one wearer to another.

A second problem with this type of surgical helmet system arises from the fact that the helmet and hood are typically separate subsystems, with no particular provisions being made for the movement of air into and out of the hood. The hood is simply worn over the helmet, so that substantial portions of the air moving within the hood is allowed to recirculate, with levels of carbon dioxide rising within the hood due to the respiration on the wearer.

Marc H. Rubman, Mark G. Siegel, Alan S. Echt, G. Edward Burroughs, and Steven W. Lenhart, in a paper entitled "Levels of Carbon Dioxide in Helmet Systems Used during Orthopaedic Operations," published in *The Journal of Bone and Joint Surgery, Incorporated*, Vol. 80A, No. 9, September 1998, pp. 1264–1269, describe the results of an investigation in which levels of carbon monoxide were measured in four helmet systems from three different manufacturers. Three of these units failed to meet the OSHA-recommended limits of 5000 ppm for exposure to carbon dioxide. The fourth unit met these limits but still had levels of carbon dioxide within the helmet which were more than 1000 per cent greater than the ambient levels in air. The systems tested included a self-contained unit with integrated blowers and a helmet with a separate external blower connected by hoses. The subjects wore operative scrub suits and standard operating-room gowns over the helmet hoods as recommended by the manufacturers. One-piece combination face shields and gowns, called togas, were not used.

In this test, the highest concentrations of carbon dioxide were found in systems that used both inflow and exhaust blowers. The question of whether the helmet was self-contained or fitted with an external blower was not found to have a significant influence on the concentration of carbon dioxide. A configuration with an external blower having four ports was found to provide a lower concentration of carbon dioxide that a system using two ports with the same external blower. The most important design factor affecting the concentration of carbon dioxide was found to be the airflow pattern, with concentrations of carbon dioxide being significantly lower in systems having a inflow blowers only than such concentrations in systems having both inflow and exhaust blowers.

Thus, what is needed is a surgical protection system having a hood with a face shield and an air handling subsystem built together in a manner allowing the placement of a port extending into the ventilation system from an aperture in the hood. It is further desirable that such a surgical protection system would be low enough in cost to allow the disposal of the entire system, as opposed to the subsequent reuse of an internal helmet.

A number of other patents describe methods for providing protective covering and for ventilation without addressing the use of a port extending into the ventilation system through an external port in the hood, and without addressing a need for a hood and ventilation system which can realistically be provided together and discarded together after a single use.

For example, U.S. Pat. No. 5,558,153 to Ignon et al. describes a surgical gown adapted to be operatively disposed to substantially cover a surgeon wearing a ventilator having a waist-mounted power unit, a waist section, and a shoulder section appropriately configure to cover analogous portions of the surgeon's body. A ventilator section, disposed between the head section and the waist section when the gown is operatively disposed on the surgeon, defines tube channel to receive the tube of the ventilator. This ventilator section forms an enlargement which facilitates movement of the head of the surgeon without substantial restriction by the head section of the gown. An interior tie gathers a front section of the gown around the neck of the surgeon to isolate movement between the head section and the shoulder section. The front section of the gown is covered with a plastic laminate to render the gown impermeable to fluids emanating from the front of the surgeon.

U.S. Pat. No. 6,014,971 to Danish et al. describes a protective system coupled with a face cradle for supporting the face shield on the wearer's head. The face shield and the wearer's face substantially define a breathing zone charged by a battery-powered blower carried on the head cradle. A bag-like inlet filter element encompasses the blower to provide filtered air to the breathing zone, and an outlet filter element is operably associated with the face shield.

U.S. Pat. No. 5,283,914 to James describes a protective helmet incorporating a visor retractable therewithin, a fan for providing filtered airflow through a duct within a shell to the visor, and ear protectors mounted substantially within the profile of the shell.

U.S. Pat. No. 4,752,974 to Haino describes an air-feed type protective helmet to which a face shield is rotatably mounted for movement between a lower use position and an upper non-use position. In order to feed clean air to a space provided between the wearer's face and the face shield, a front visor portion is provided, forming a channel which extends between lateral sides of the helmet. An air outlet extends along a lower surface of the channel. An air pipe connector, in fluid communication with the air passage, is located on a lateral side of the helmet. A source of clean air can be connected to the air pipe connection.

U.S. Pat. No. 5,937,445 to Ravo et al. describes a one-piece surgical shield and cap including a substantially planar blank with an eye opening formed therethrough. Straps are attached to the side edges of the blank for connecting the one-piece surgical shield and cap to the user. The upper portion of the blank above the eye opening forms the cap portion, and the lower portion of the blank below the eye opening forms the shield portion. Elastic bands may be provided, surrounding the eye opening to further secure the one piece surgical shield and cap to the user.

U.S. Pat. No. 4,986,282 to Stackhouse et al. describes a face shield system pivotally mounted on an adjustable carrier having straps extending around and above the head.

SUMMARY OF THE INVENTION

According to a first aspect of the present invention, there is provided apparatus forming a protective barrier between a face and head of a wearer of the apparatus and a surgical environment. The apparatus includes a face shield and a head covering. The face shield is formed as a transparent tube, including a top edge, being formed to extend across the face and around a portion of the head. The head covering extends across the top edge of the face shield and downward around the face shield. The head covering includes a viewing aperture formed to extend across the face, and is adhesively attached to the face shield around the viewing aperture.

DESCRIPTION OF THE INVENTION

Figure 1:
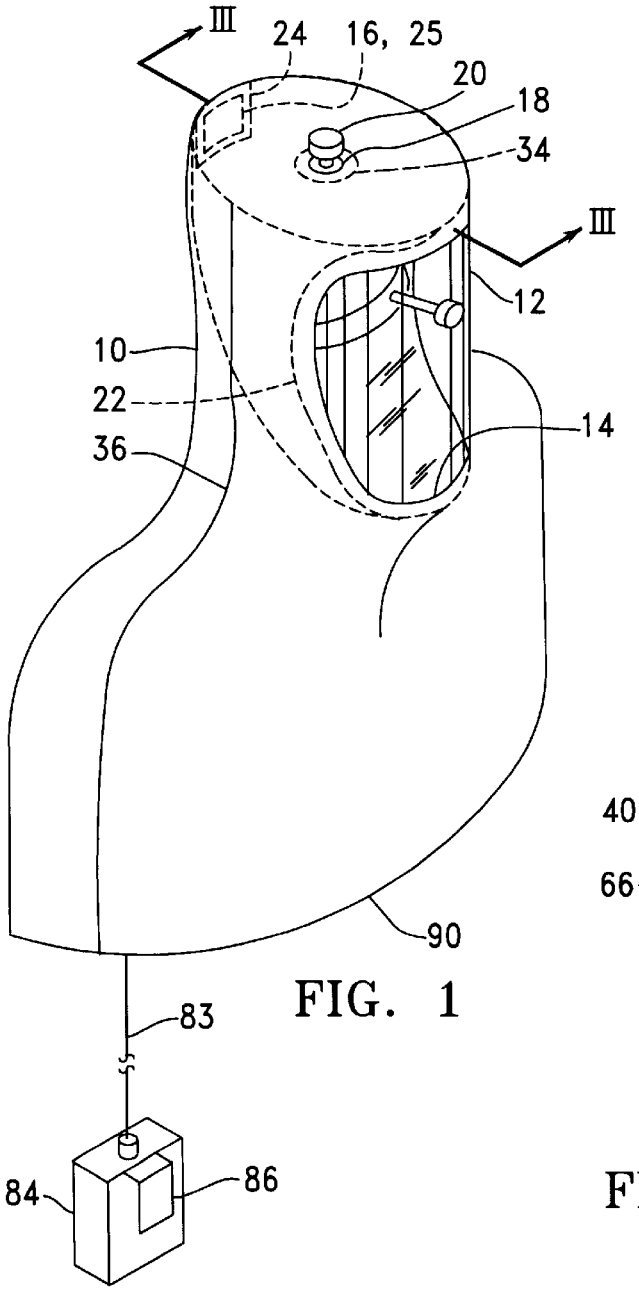
FIG. 1 is a perspective view of a ventilated face shield and head covering built in accordance with the present invention.

FIG. 1 is a perspective view of a ventilated face shield 12 and head covering 10 built in accordance with the present invention. The head covering 10 is preferably constructed of a material which is impermeable to fluids, such as a woven or non-woven fabric coated with a plastic laminate or impregnated to prevent the passage of fluids through the material. The face shield 12 is preferably composed of a clear, transparent, thermoplastic sheet material, such as polycarbonate, having a thickness of about 1 mm (0.04 inch). In the example of FIG. 1, the head covering 10 covers the head and shoulders of a wearer. Alternatively, the head covering 10 may be extended downward to cover more of the arms, and by include sleeves through which the arms are drawn.

Figure 3:
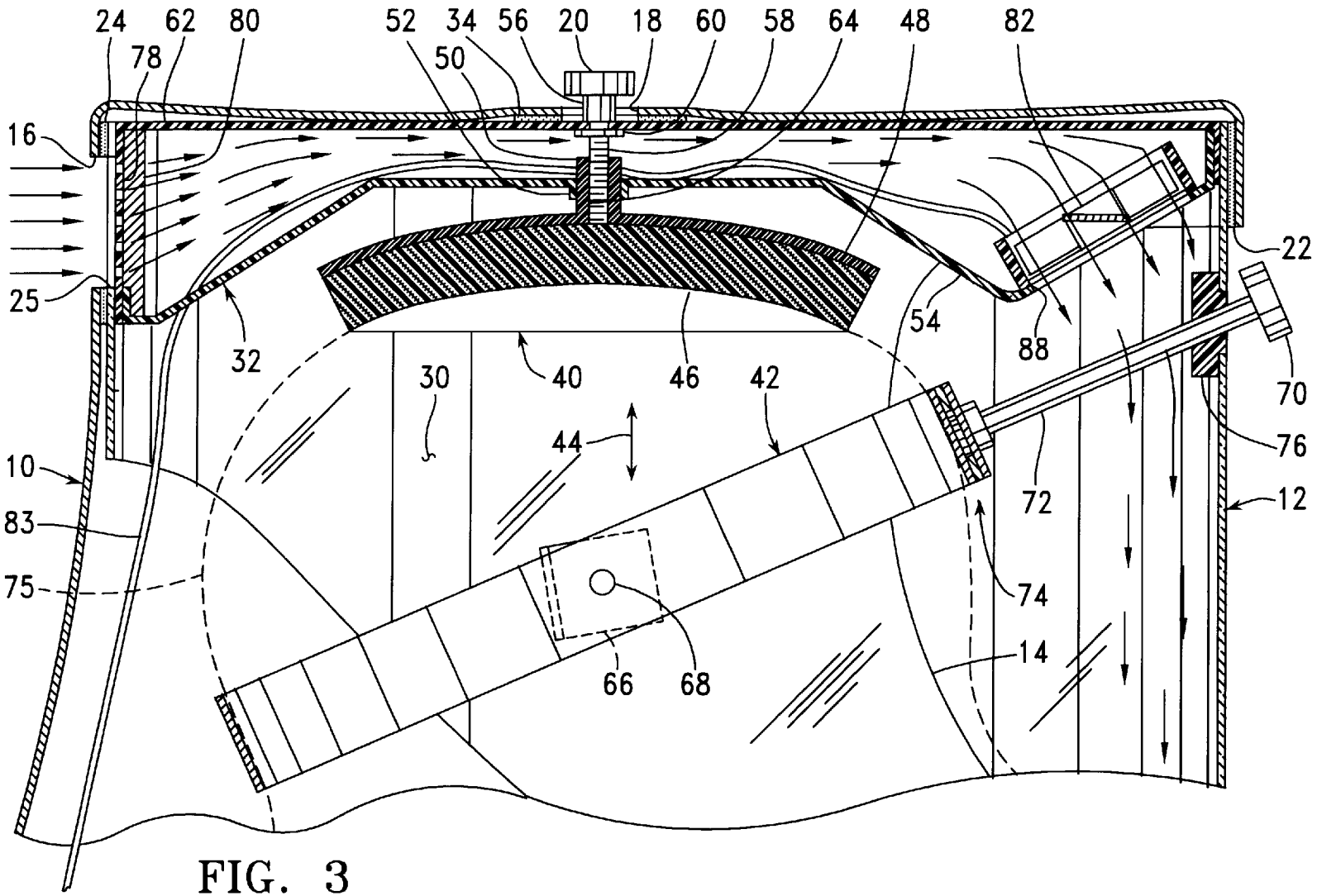
FIG. 3 is a fragmentary vertical cross-sectional elevation of the ventilated face shield and head covering of FIG. 1, taken as indicated by section lines III—III in FIG. 1.

The head covering 10 includes a viewing aperture 14, extending generally around the portion of the face shield 12 lying in front of the face of the wearer, an air intake aperture 16, providing for an intake of fresh air from behind the head of the wearer, and a top aperture 18 providing for a knob 20, which is used to adjust a cap, to be discussed in reference to FIG. 3, within the face shield 12. The head covering 10 is attached to the face shield 12 around the viewing aperture 14, and the air intake aperture 16, preferably using segments of double-sided adhesive tape 22, 24. The face shield 12 also includes, at its rear, an air intake aperture 25 coextensive with the air intake aperture 16 of the head covering 10.

Figure 2:
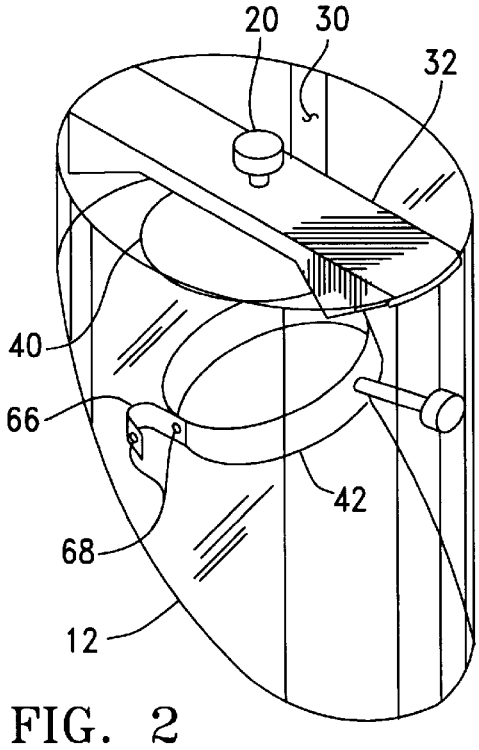
FIG. 2 is a perspective view of the ventilated face shield of FIG. 1 and structures internal thereto, shown with the head covering removed.

FIG. 2 is a perspective view of the ventilated face shield 12, together with structures within the face shield 12, with the head covering 10 removed. The face shield 12 is formed of a curved thermoplastic sheet, formed into an overlapping condition in a region 30. In this region 30 of overlap, the opposite ends of the material forming the face shield 12 are joined by a bonding process, such as welding by heat or by ultrasonic welding, or by bonding with a solvent or adhesive. The face shield 12 is retained as an oval-shaped tube by means of a support structure 32 extending between the front and rear internal surfaces of the face shield 12. The ends of the support structure are attached to adjacent portions of the face shield 12, preferably by means of an adhesive, or by means of clips (not shown).

Referring to FIGS. 1 and 2, the oval shape of the face shield 12 defines the shape of the upper portion of the head covering 10, with attachment being made between the head covering 10 and the face shield 12 with double-sided adhesive tape segments 22, 24, and between the head covering 10 and the support structure 32 by means of a double-sided adhesive tape segment 34. In order to permit the forming of the head covering 10 into this shape, the material forming this head covering may be cut into a number of segments joined by seams 36.

FIG. 3 is a fragmentary vertical cross-sectional view of the head covering 10, of the face shield 12, and of associated internal components. This apparatus is held in place on the wearer's head by means of an adjustable cap 40 and by means of an adjustable headband 42. The adjustable cap 40 is movable in the vertical directions of arrow 44 by means of rotation of the knob 20 extending through the aperture 18 in the head covering 10. The cap 40 includes an elastomeric foam layer 46 formed under a thermoplastic resin shell 48. The shell 48 includes a square section 50, sliding within a square aperture 52 within a lower cover 54 of the support structure 32. The knob 20 includes a shoulder 56 and a descending externally-threaded shaft 58. A clip 60 is snapped in place over the shaft 58 so that upper cover 62 of the support structure 32, being trapped between the shoulder 56 and the clip 60, controls the vertical position of the knob 20. The externally-threaded shaft 58 engages an internally-threaded hole 64 within the shell 48 of the cap 40, which is therefor moved upward and downward by rotating the knob 20.

Referring to FIGS. 2 and 3, the adjustable headband 42 is held in place by means of a flexible clip 66 extending at each side (right and left) between the headband 42 and an adjacent surface of the face shield 12. Each clip 66 is attached to the headband 42 and to the face shield 12 by means of a pair of rivets 68. The circumference of the headband 42 is adjusted by rotation of a knob 70, having a shaft 72 extending through the face shield 12 to operate a headband adjusting mechanism 74. The shaft 72 extends through a bushing 76 attached within the face shield 12 to stabilize the position of the shaft 72 while allowing its rotation. The headband adjusting mechanism 74 is of a type well-known to those skilled in the art of designing various types of headgear and protective apparatus. Such a headband adjusting mechanism is described in U.S. Pat. No. 4,986,282 as including overlapping end straps or cross bands, provided with suitable ratchet formations, sliding in an overlapping relation within a housing, and as further including a knob with an appropriate pinion configuration within the housing to engage the straps and retract or extend them.

Dashed lines 75 show an outline of the wearer's head in position within the headband 42 and under the cap 40.

In protective apparatus described in the prior art, headband adjusting knobs are placed in the rear. In an operating room environment, the rear of the head is generally considered to be outside the sterile field, so any adjustments made to the headband of a surgeon or other individual having a responsibility to maintain sterile gloves must be made by another person. Such adjustments are then made without feedback, except for voice communications.

Therefore, in accordance with a preferred version of the present invention, the headband adjusting knob 70 extends through the front of the face shield 12, as shown. The wearer can make any needed adjustments by turning the knob 70 without removing his gloved hands from the sterile field, with immediate feedback being provided to determine when the headband fits correctly. Alternately, the adjustable headband 42 may be adjusted with a knob (not shown) extending rearward, as in conventional apparatus.

The support structure 32 is further configured to provide a passageway for air pulled through the aperture 16 in the rear of the head covering 10 and through the aperture 25 in the rear of the face shield 12. The rear end wall 78 of the support structure 32 is slotted to permit the passage of air through a filter 80 held within the support structure 32, with the air being pulled by a fan 82 operating in the front of the support structure 32. Electrical power for the fan 82 is provided through a two-conductor cord 83 extending from the fan 82 within the support structure 32 and descending therefrom to a rechargeable battery 84 (shown in FIG. 1) having a clip 86 for attachment to the wearer's belt. Thus, the fan 82 pulls air inward from the rear of the head cover 10, in a location where clean air is available since it is removed from the area in which blood and tissue can be splattered during a surgical procedure. Air exits the fan 82 through an aperture 88 within the lower cover 32 of the support structure 32, to move downward in front of the face of the wearer. In this way, fresh air is provided for the wearer, and the carbon dioxide exhaled by the wearer is carried downward, being mixed with the air from fan 82, to be exhausted through a gap between the lower edge 90 of the head covering 10 and other garments (not shown) extending below the head covering 10. Air directed downward in this way is directed away from the surgical site and from the patient, providing protection from contamination.

The various subsystems described above, including the face shield 12, the support structure 32, the cap 40, the adjustable headband 42, and the head covering 12, are preferably assembled and then sterilized as an assembly. The rigid structure provided by the tubular shape of the face shield 12, together with the support structure 32, holds the head covering 10 in the required shape. The simplicity of this structure allows the assembly to be light in weight and low enough in cost that the entire assembly can be disposed of after a single use. This capability provides an advantage of eliminating a risk of contamination occurring from one wearer to another. Unlike the conventional approach, there is no internal helmet to be reused after the outer covering is discarded.

Furthermore, since the various subsystems, including the head covering 10, are assembled as a unit, apertures 16, 25 are readily provided within the head covering 10 and the face shield 12 for the flow of air from behind the wearer's head into the air channel provided within the support structure 32. These apertures provide the apparatus of the present invention with a significant advantage over the conventional approach of installing a helmet including a fan under a head covering without making a particular provision for the flow of outside air into the head covering. With the apparatus of the present invention, air brought in from the outside through the apertures 16, 25 provides for a similar outflow of air, which carries away the carbon dioxide exhaled by the wearer.

While the present invention has been described in its preferred forms of embodiments with some degree of particularity, it is understood that this description has been given only by way of example and that numerous changes in the details of construction, fabrication, and use, including changes in the combination and arrangement of parts, may be made without departing from the spirit and scope of the invention.

I claim:

1. Apparatus to provide a protective barrier between a face and head of a wearer of said apparatus and a surgical environment, wherein said apparatus comprises:

a face shield formed as a transparent tube, including a top edge, wherein said face shield is formed to extend across said face and around a portion of said head;

a head covering extending across said top edge of said face shield and downward around said face shield, wherein said head covering includes a viewing aperture formed to extend across said face, wherein a rear portion of said head covering includes a first air inlet aperture, and wherein said head covering is adhesively attached to said face shield around said viewing aperture;

a support structure extending between front and rear portions of said face shield; and an air supply structure including an air outlet aperture adjacent a front end of said air supply structure, an air channel extending between a position aligned with said first air inlet aperture and said air outlet aperture, and a fan moving air from said first air inlet aperture to said air outlet aperture, wherein said support structure forms said air supply structure, said rear portion of said face shield includes a second air inlet aperture aligned with said first air inlet aperture, and said head covering is attached to said face shield around said first air inlet aperture.

2. Apparatus to provide a protective barrier between a face and head of a wearer of said apparatus and a surgical environment, wherein said apparatus comprises:

a face shield formed as a transparent tube, including a top edge, wherein said face shield is formed to extend across said face and around a portion of said head;

a head covering extending across said top edge of said face shield and downward around said face shield, wherein said head covering includes a viewing aperture formed to extend across said face, and wherein said head covering is adhesively attached to said face shield around said viewing aperture; and a support structure extending between front and rear portions of said face shield;

a cap attached to said support structure, downwardly disposed from said support structure, for supporting said apparatus on said head, wherein said cap includes a threaded adjustment surface; and a cap adjustment knob having screw threads, engaging said threaded adjustment surface to move said cap upward and downward with rotation of said cap adjustment knob.

3. The apparatus of claim 2, wherein said cap adjustment knob is rotatably mounted within said support structure, said head covering includes a cap adjustment knob aperture through which said cap adjustment knob extends, and said head covering is attached to said support structure around said cap adjustment knob aperture.

4. The apparatus of claim 2, additionally comprising a headband resiliently supported by attachment to opposite sides of said face shield, wherein said headband is disposed within said face shield below said cap.

5. The apparatus of claim 4, wherein said headband includes a headband adjustment mechanism for adjusting a circumferential length of said headband, said front surface of said face shield includes a headband adjusting aperture, said apparatus includes a headband adjustment knob extending outwardly through said headband adjusting aperture, and said headband adjusting mechanism adjusts said circumferential length in response to rotation of said headband adjustment knob.

6. Apparatus to provide a protective barrier between a face and head of a wearer of said apparatus and a surgical environment, wherein said apparatus comprises:

a transparent face shield formed to extend across said face and as a tube to extend around a portion of said head, a head covering formed to extend around and above said head, wherein said head covering includes a viewing aperture formed to extend across said face and a first air inlet aperture extending along a side of said head covering opposite said viewing aperture, wherein said head covering is attached to said face shield around said viewing aperture; and an air supply structure including a slotted air inlet aperture coextensive with said first air inlet aperture, an air outlet aperture at an end of said air supply structure opposite said slotted air inlet, an air channel extending between said slotted air inlet aperture and said air outlet aperture, and a fan moving air from said slotted air inlet aperture to said air outlet aperture, wherein said air supply structure is attached to said face shield to extend between a rear portion of said face shield and a front portion of said face shield, wherein said rear portion of said face shield includes a second air inlet aperture coextensive with said first air inlet aperture, and wherein said head covering is attached to said face shield around said second air inlet aperture.

7. Apparatus to provide a protective barrier between a face and head of a wearer of said apparatus and a surgical environment, wherein said apparatus comprises:

a transparent face shield formed to extend across said face, wherein said transparent face shield includes a headband adjustment aperture to be disposed above said face;

a head covering formed to extend around and above said head, wherein said head covering includes a viewing aperture formed to extend across said face and a first air inlet aperture extending along a side of said head covering opposite said viewing aperture, wherein said head covering is attached to said face shield around said viewing aperture;

a headband resiliently supported by attachment to opposite sides of said face shield, wherein said headband includes a headband adjustment mechanism for adjusting a circumferential length of said headband; and a headband adjustment knob extending outwardly through said headband adjustment aperture, wherein rotation of said headband adjustment knob causes said headband adjustment mechanism to adjust said circumferential length of said headband.

8. The apparatus of claim 7, wherein said face shield is formed as a tube to extend around a portion of said head, and said apparatus additionally comprises a support structure extending between front and rear portions of said face shield.

9. The apparatus of claim 8, additionally comprising a cap attached to said support structure, downwardly disposed from said support structure, for supporting said apparatus on said head.

10. The apparatus of claim 9, wherein said cap includes a threaded adjustment surface, and said apparatus additionally comprises a cap adjustment knob having screw threads, engaging said threaded adjustment surface to move said cap upward and downward with rotation of said cap adjustment knob.

11. The apparatus of claim 10, wherein said cap adjustment knob is rotatably mounted within said support structure, said head covering includes a cap adjustment knob aperture through which said cap adjustment knob extends, and said head covering is attached to said support structure around said cap adjustment knob aperture.

* * * * *